US009764868B2

(12) United States Patent
Hu et al.

(10) Patent No.: US 9,764,868 B2
(45) Date of Patent: Sep. 19, 2017

(54) CAVITY-TYPE VACUUM SEALING MACHINE

(71) Applicant: Bigland Electric Appliance Co., Ltd., Guangdong Province (CN)

(72) Inventors: Zhihe Hu, Guangdong Province (CN); Xinzhai Zheng, Guangdong Province (CN)

( * ) Notice: Subject to any disclaimer, the term of this patent is extended or adjusted under 35 U.S.C. 154(b) by 402 days.

(21) Appl. No.: 14/547,138

(22) Filed: Nov. 19, 2014

(65) Prior Publication Data

US 2015/0135640 A1 May 21, 2015

(30) Foreign Application Priority Data

Nov. 19, 2013 (CN) ..... 2013 2 0729945 U
Nov. 19, 2013 (CN) ..... 2013 2 0730298 U

(51) Int. Cl.

| | |
|---|---|
| ***F04B 1/00*** | (2006.01) |
| ***B65B 31/02*** | (2006.01) |
| ***B65B 31/04*** | (2006.01) |
| ***B65B 51/14*** | (2006.01) |
| ***B65B 51/10*** | (2006.01) |

(52) U.S. Cl.

CPC ..... *B65B 31/024* (2013.01); *B65B 51/10* (2013.01); *B65B 51/146* (2013.01)

(58) Field of Classification Search

CPC .... F04B 27/02; F04B 27/053; F04B 27/0536; F04B 27/0538; B65B 31/02; B65B 31/04; B65B 53/00

USPC ..... 417/273

See application file for complete search history.

(56) References Cited

U.S. PATENT DOCUMENTS

| | | | | |
|---|---|---|---|---|
| 4,779,398 | A * | 10/1988 | Glandon | B65B 31/08 53/434 |
| 4,922,686 | A * | 5/1990 | Segota | B65B 31/024 53/434 |
| 5,056,292 | A * | 10/1991 | Natterer | B29C 65/18 53/373.4 |
| 5,638,664 | A * | 6/1997 | Levsen | B29C 66/0044 53/372.6 |
| 2003/0046907 | A1* | 3/2003 | Costello | B65B 31/024 53/512 |
| 2005/0011166 | A1* | 1/2005 | Germano | B65B 31/047 53/512 |
| 2005/0050855 | A1* | 3/2005 | Baptista | B65B 51/146 53/434 |

(Continued)

*Primary Examiner* — Andrew M Tecco
*Assistant Examiner* — Praachi M Pathak
(74) *Attorney, Agent, or Firm* — Prakash Nama; Global IP Services, PLLC

(57) ABSTRACT

The utility model discloses a cavity-type vacuum sealing machine, comprising a machine body and a cover which covers the machine body. The machine body is internally provided with a tray; an airtight cavity for holding packaging bags is formed between the tray and the cover; the cavity is internally provided with a hot-pressing bar and a heating and sealing component for sealing the packaging bags; the machine body is internally provided with a vacuum pump set for vacuumization; and the suction ports of the vacuum pump set communicate with the airtight cavity for holding the packaging bags via tubes. The cavity-type vacuum machine disclosed by the utility model has the advantages of smaller volume and small occupied space.

9 Claims, 5 Drawing Sheets

(56) References Cited

U.S. PATENT DOCUMENTS

| | | | | |
|---|---|---|---|---|
| 2005/0050856 | A1* | 3/2005 | Baptista | B65B 51/146 53/434 |
| 2010/0095638 | A1* | 4/2010 | Zakowski | B65B 51/148 53/433 |
| 2012/0060447 | A1* | 3/2012 | Liu | B65B 31/048 53/434 |
| 2013/0097967 | A1* | 4/2013 | Picozza | B65B 31/04 53/408 |
| 2014/0116003 | A1* | 5/2014 | Hammad | B65B 7/06 53/376.3 |
| 2015/0135641 | A1* | 5/2015 | Hu | B65B 51/10 53/86 |

* cited by examiner

CAVITY-TYPE VACUUM SEALING MACHINE

BACKGROUND OF THE INVENTION

The utility model relates to the field of the vacuum sealing machine, in particular to a cavity-type vacuum sealing machine with small volume and low cost.

The vacuum sealing machine finishes the sealing procedure by putting food into a packaging bag and pumping air out of the packaging bag to achieve the predetermined vacuum degree. The vacuum sealing machine can have the following functions of vacuumizing and sealing the bag or directly sealing the mouth of the bag. The prior vacuum sealing machine is generally divided into two types; one is a direct-pump type incapable of packaging products containing high liquid and the other is a cavity type capable of packaging products containing high liquid or pure liquid products. However, the prior cavity-type vacuum sealing machine is only used in the large production occasions such as factories; and the vacuum sealing machine utilizes a large vacuum pump, has the disadvantages of complex structure, high cost and large volume and is not suitable for household use. The prior small vacuum sealing machine for household use is just the direct pump type, which is incapable of packaging products containing high liquid or pure liquid products and does not meet the household requirements of packaging products containing high liquid or pure liquid products.

The prior household vacuum sealing machine has smaller volume and generally employs a small vacuum pump; the vacuum pump utilizes a direct-current motor and has one suction port and one exhaust port; the vacuum pump has slow pumping speed and low pumping pressure, which results in lower pumping efficiency and may result in too much air remained in the packaging bag, so that the shelf life of food in the packaging bag cannot be guaranteed. Two pumps are also utilized; two pumps in the dual-pump structure can only be connected in series or in parallel; the pumping speed cannot be accelerated when the vacuum pressure is boosted or the vacuum pressure cannot be boosted when the pumping speed is accelerated. In addition, the current occasions such as factories generally utilize the large vacuum sealing machine, which utilizes a large vacuum pump or a rotary-vane vacuum pump and uses a large alternating current motor; although the vacuum pump has high pumping speed and high pumping pressure, it has large volume and high cost and is not suitable for families and small sites.

BRIEF SUMMARY OF THE INVENTION

The utility model overcomes the shortcomings of the prior art and provides a cavity-type vacuum sealing machine, which has the advantages of simple structure, low cost, small volume, saved occupation space and capability of packaging liquid-containing products.

To solve the technical problems, the utility model utilizes the following technical schemes:

A cavity-type vacuum sealing machine comprises a machine body and a cover which covers the machine body. The machine body is internally provided with a tray; an airtight cavity for holding packaging bags is formed between the tray and the cover; the cavity is internally provided with a hot-pressing bar and a heating and sealing component for sealing the packaging bags; the machine body is internally provided with a vacuum pump set for vacuumization; and the suction ports of the vacuum pump set communicate with the airtight cavity for holding the packaging bags via tubes.

The machine body is internally provided with a rolled bag chamber for holding rolled bags; the rolled bag chamber is located in the front of the machine body and the front side of the machine body is provided with a chamber door for opening the rolled bag chamber.

The bottom side of the tray is an oblique plane; and the mouths of the packaging bags in the cavity are located on the top of the oblique plane.

A connecting rod is arranged between the cover and the machine body; and two ends of the connecting rod are respectively hinged with the cover and the machine body.

The cover comprises an upper cover and a lower cover, which fit together; and a control panel is arranged on the upper cover.

The machine body is provided with a safety switch; and the safety switch is located at the location of the connecting rod and is actuated through the connecting rod.

The vacuum pump set is a vacuum pump, comprising a housing, a driver and air pumps driven by the driver. The driver is a dual-head motor; output shafts at two ends of the motor are connected with eccentric wheels; four air pumps are arranged; one eccentric wheel is connected with two air pumps; each air pump is connected with a suction port and an exhaust port, which communicate with the air pump; and one-way valves are arranged between the suction ports and the air pumps and between the exhaust ports and the air pumps.

Each air pump comprises a connecting rod, a piston connected with the connecting rod and a cylinder having an air cavity; the head of the connecting rod is connected to the eccentric position of the eccentric wheel; and the cylinder is provided with a cylinder bottom cover, which is provided with a suction passage and an exhaust passage.

Each one-way valve comprises a valve and a valve bottom cover; the valve is located between the cylinder bottom cover and the valve bottom cover; the valve is provided with two air-blocking pads which are respectively located at the suction passage and the exhaust passage; and the valve bottom cover is provided with air passages, which respectively communicate with the suction ports and the exhaust ports.

The housing comprises an upper cover and a lower cover, which are buckled with each other.

The cylinders are provided with raised structures; the housing is provided with concave holes matched with the raised structures; and the cylinders are clamped in the concave holes through the raised structures and fixed in the housing.

According to the cavity-type vacuum sealing machine disclosed by the utility model, the vacuum pump set is utilized and the use of a big vacuum pump is avoided, so that the whole volume of the machine is reduced; the vacuum pump set consists of the small vacuum pumps; one driver is utilized to drive four air pumps to work synchronously; the vacuum pump set has the advantages of simple structure, stable working and capability of continuously pumping air; one driver is utilized to drive four air pumps to work, so that the working efficiency is higher; the pumping pressure is boosted, the vacuum degree is increased and the vacuum sealing machine has a plurality of suction ports and exhaust ports; the tube connection of the suction ports and the exhaust ports can be changed according to the required pumping pressure and the pumping speed, and the vacuum sealing machine has wider scope of application. The pumping pressure and the pumping speed can be achieved through different tube connections; and the vacuum sealing machine has the advantages of smaller volume, light weight, small occupation space and low cost and is suitable for families and small workshops.

The tray with the oblique bottom side is arranged; the tray enables the liquid in the packaging bag to flow toward the bag bottom and prevents the sealing effect from being influenced by too much liquid attached on the mouth of the bag. Furthermore, the hot-pressing bar and the heating and sealing component are capable of evaporating a small amount of liquid at the mouth of the bag, and the sealing effect of the vacuum sealing machine to the packaging bags is further guaranteed.

DETAILED DESCRIPTION OF THE INVENTION

To facilitate the understanding of the technicians in the field, the utility model is further described with the following drawings.

Figure 1:
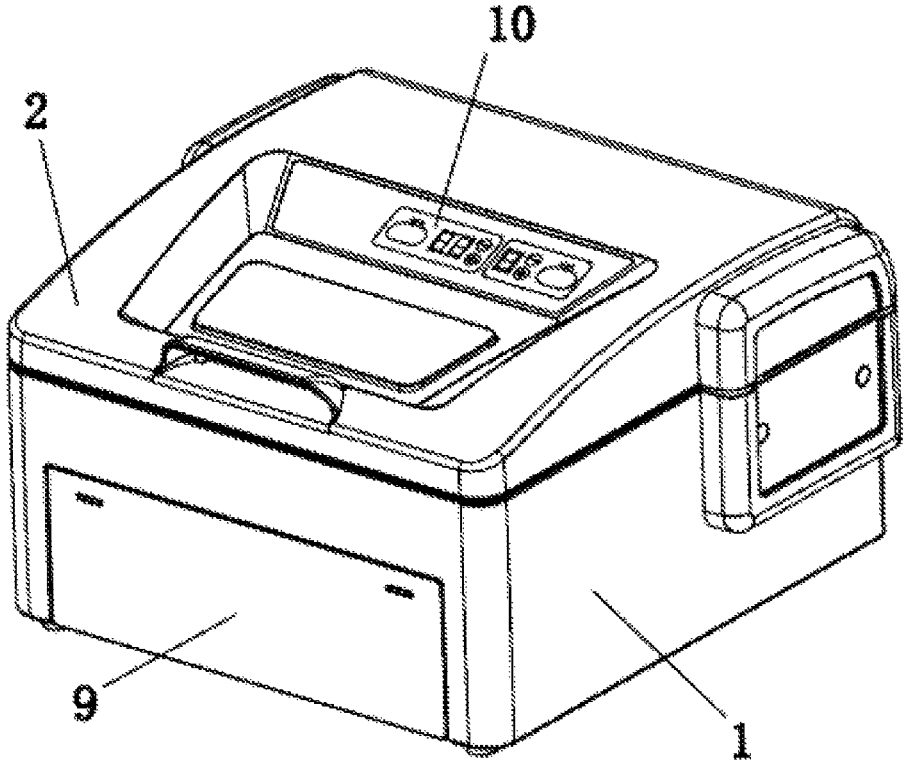
FIG. 1 is the three-dimensional structure diagram of the utility model.
Figure 2:
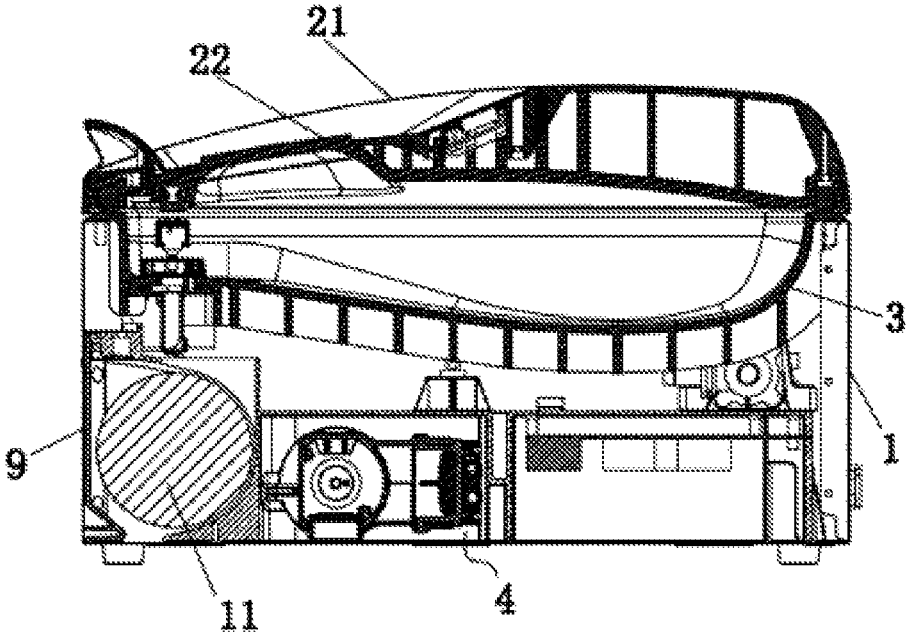
FIG. 2 is the cross-sectional structure diagram of the utility model.
Figure 3:
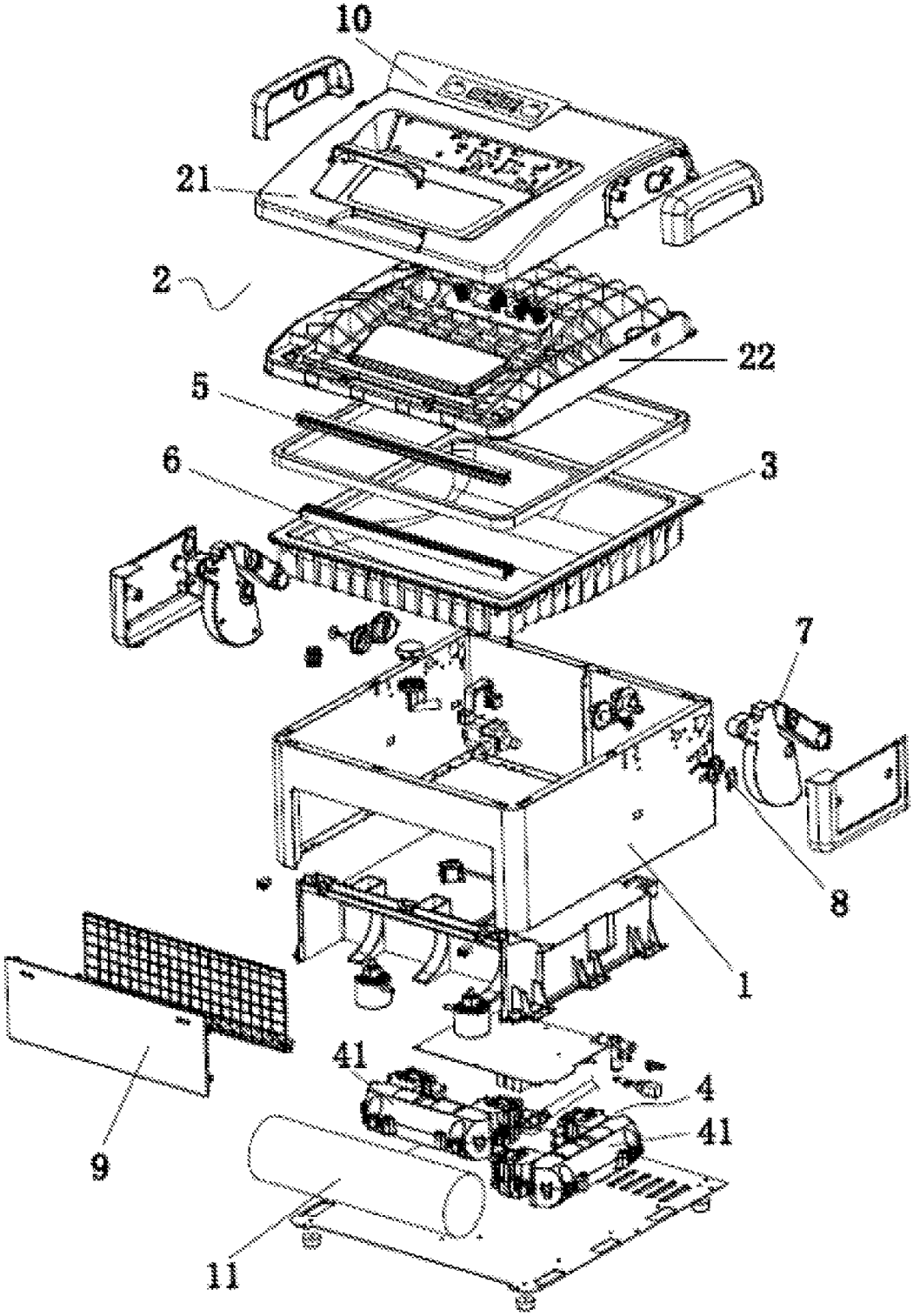
FIG. 3 is the breakdown structure diagram of the parts of the utility model.

As shown in FIG. 1, FIG. 2 and FIG. 3, a cavity-type vacuum sealing machine comprises a machine body 1 and a cover 2 which covers the machine body. The cover 2 comprises an upper cover 21 and a lower cover 22, which fit together; and a control panel 10 is arranged on the upper cover 21. The machine body 1 is internally provided with a tray 3; an airtight cavity for holding the packaging bags is formed between the tray 3 and the cover 1; and the cavity is internally provided with a hot-pressing bar 5 and a heating and sealing component 6 for sealing the packaging bags. The bottom side of the tray 3 is an oblique plane; the mouth of the packaging bag is located at the top of the oblique plane. While being sealed, the packaging bag is arranged on a slant on the tray 3; if the packaging bag contains liquid, the liquid flows from the bottom side of the tray 3 to the bag bottom, so that too much liquid attached on the mouth of the bag is avoided. The hot-pressing bar 5 and the heating and sealing component 6 are capable of evaporating a small amount of liquid at the mouth of the packaging bag to be sealed, and then the packaging bag is sealed, so that the sealing quality is guaranteed. The rolled bag chamber is located in the front of the machine body 1.

Figure 4:
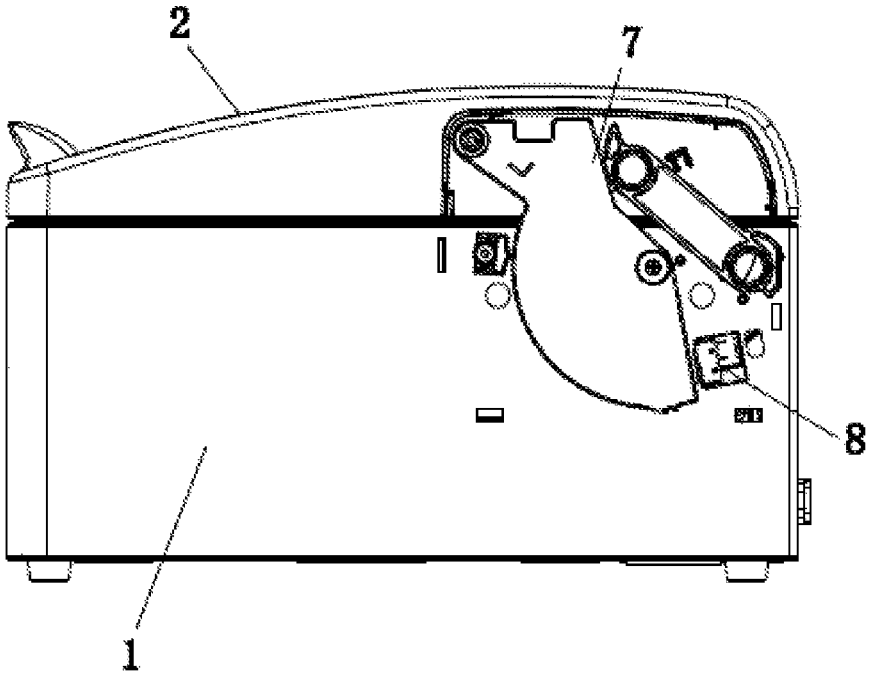
FIG. 4 is the state structure diagram of the utility model when the cover is closed.
Figure 5:
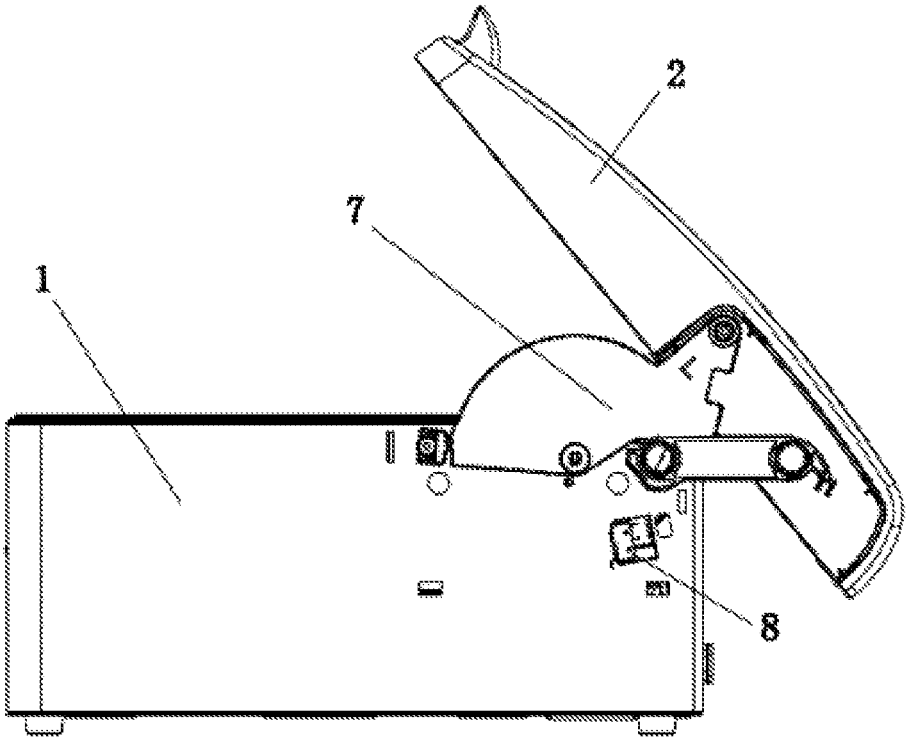
FIG. 5 is the state structure diagram of the utility model when the cover is open.
Figure 6:
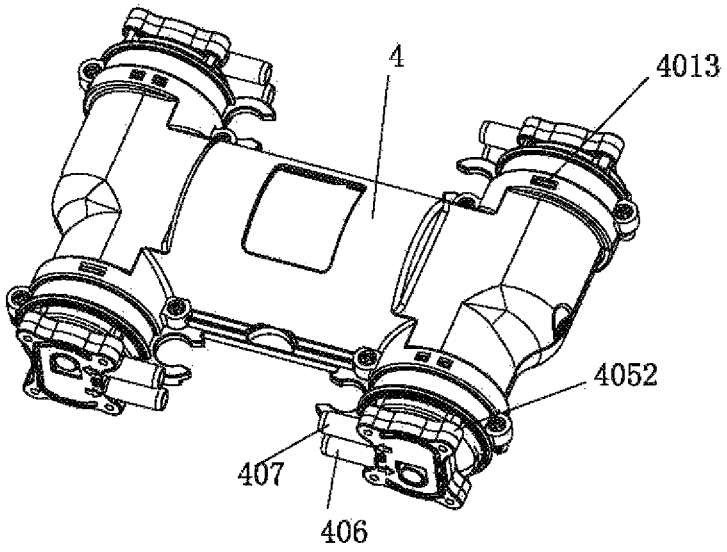
FIG. 6 is the three-dimensional structure diagram of the vacuum pump of the utility model.
Figure 7:
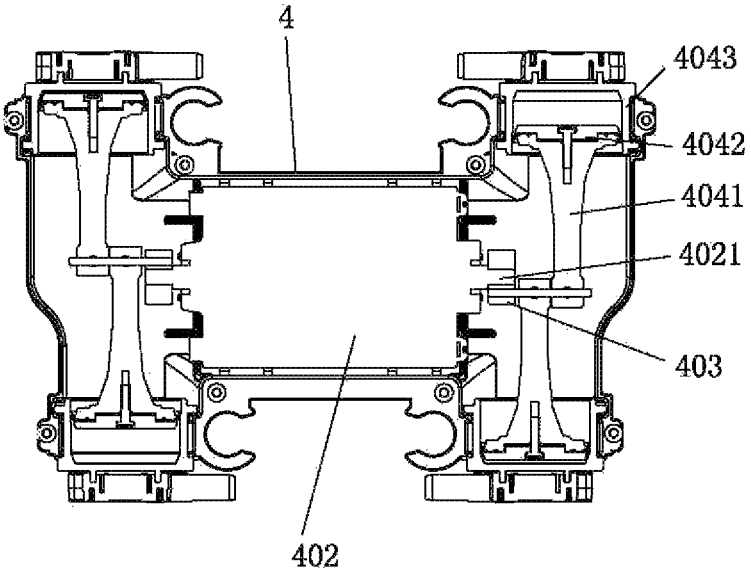
FIG. 7 is the cross-sectional structure diagram of the vacuum pump of the utility model.
Figure 8:
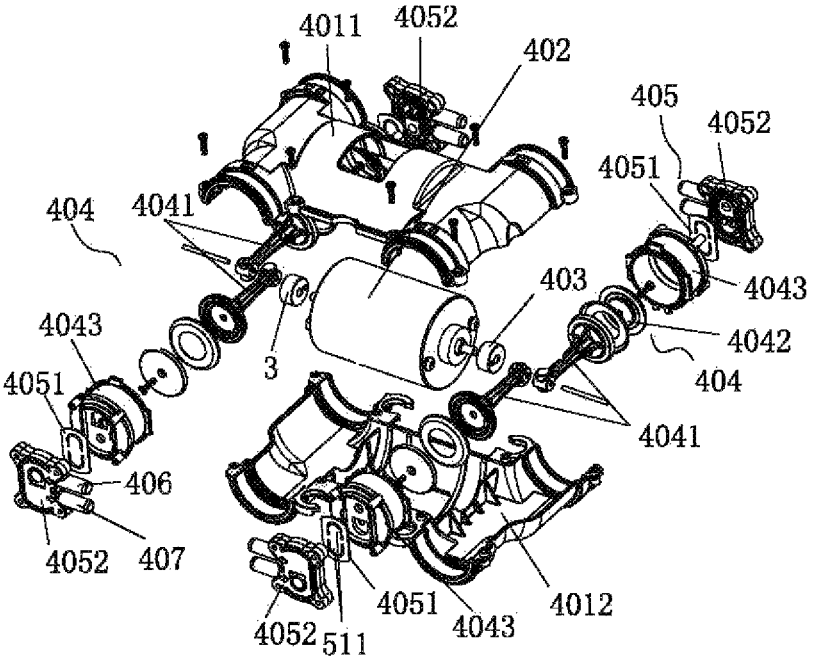
FIG. 8 is the breakdown structure diagram of the parts of the vacuum pump of the utility model.
Figure 9:
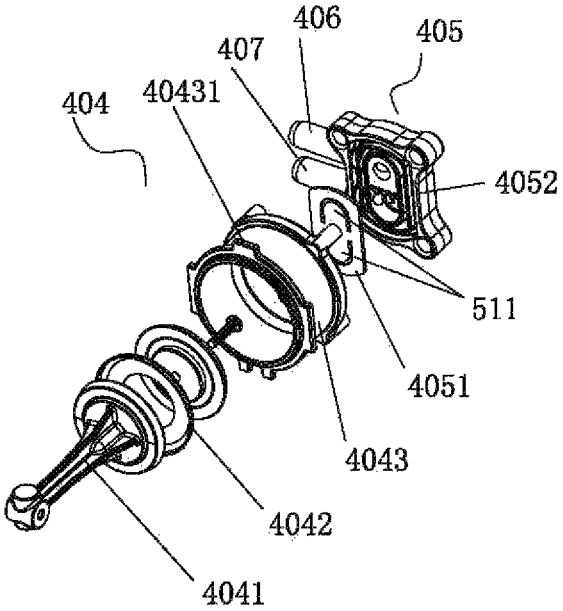
FIG. 9 is the breakdown structure diagram of the parts of the utility model at the air pumps and the valves.

As shown in FIG. 4 and FIG. 5, a connecting rod 7 is arranged between the cover 2 and the machine body 1 and two ends of the connecting rod 7 are respectively hinged with the cover 2 and the machine body 1. The machine body 1 is provided with the safety switch 8 and the safety switch 8 is located at the location of the connecting rod 7 and actuated through the connecting rod 7. When the cover 2 is closed, the connecting rod 7 contacts with the safety switch 8, the circuit of the machine is closed and the machine can work normally. When the cover 2 is open, the connecting rod 7 is far away from the safety switch 8 and the circuit of the machine is cut off to prevent the occurrence of accidents.

As shown in FIG. 6-9, the machine body 1 is internally provided with a rolled bag chamber for holding rolled bags 11 and a vacuum pump set 4 for vacuumization; and the suction ports of the vacuum pump set 4 communicate with the airtight cavity for holding the packaging bag. The vacuum pump set 4 comprises a vacuum pump, comprising a housing, a driver 402 and air pumps 404 driven by the driver 402. The housing 4011 comprises an upper cover 4011 and a lower cover 4012, which are buckled with each other to enclose the driver 402 and the air pumps 404. The driver 402 and the air pumps 404 are connected through eccentric wheels 403; the air pumps 404 are connected with suction ports 406 and exhaust ports 407, which communicate with the air pumps; one-way valves 405 are arranged between the suction ports 406 and the air pumps 404 and between the exhaust ports 407 and the air pumps 404; the suction ports 406 are used for pumping air in the packaging bag, the exhaust ports 407 are used for discharging air pumped by the air pumps 404, and the one-way valves 405 are used for preventing the air exhaustion of the suction passages and the air intake of the exhaust passages. The driver 402 is a dual-head motor; output shafts 4021 at two ends of the motor are connected with the eccentric wheels 403; four air pumps 404 are arranged; one eccentric wheel 403 are connected with two air pumps 404; each air pump 404 is connected with the suction port 406 and the exhaust port 407, that is, one dual-head motor drives four air pumps 4 to work at the same time.

The air pump 404 comprises a connecting rod 4041, a piston 4042 connected with the connecting rod 4041 and a cylinder 4043 having an air cavity; the head of the connecting rod 4041 is connected to the eccentric position of the eccentric wheel 403; the cylinder 4043 is provided with a cylinder bottom cover, which is provided with the suction passage and the exhaust passage. The one-way valve 405 comprises a valve 4051 and a valve bottom cover 4052; the valve 4051 is located between the cylinder bottom cover 4043 and the valve bottom cover 4052; the valve 4051 is provided with two air-blocking pads 511, which are respectively located at the suction passages and the exhaust passages and the air-blocking pads 511 are used to unidirectionally close the suction passage and the exhaust passage, that is, the suction passage cannot exhaust air and the exhaust passage cannot intake air. The valve bottom covers 4052 are provided with air passages, which respectively communicate with the suction ports 406 and the exhaust ports 407. The cylinders 4043 are provided with raised structures 40431; the housing 1 is provided with concave holes 4013 matched with the raised structures 40431; and the cylinders 4043 are clamped in the concave holes 4013 through the raised structures 40431 and fixed in the housing 1.

The working process of the embodiment is as follows: the dual-head motor is started to drive the eccentric wheels 403 at two ends of the dual-head motor to rotate and then drive the four connecting rods 4041 to reciprocate; the connecting rods 4041 drives the pistons 4042 to reciprocate in the cylinders 4043, so that the volumes of the internal cavities of the cylinders 4043 are changed and the air suction and the air exhaustion are realized; during air suction, one air-blocking pad 511 closes the exhaust passage and the air is pumped from the suction port 406 to the pump; during air exhaustion, the other air-blocking pad 511 closes the suction passage and the air is discharged from the exhaust port 407. The vacuum pump has four air pumps 404; the air pumps 404 can be connected in series to boost the pumping pressure, can be connected in parallel to accelerate the pumping speed or can be used in a serial-parallel connection to achieve the actual use requirements. One driver drives four air pumps to work synchronously, so that the pumping pressure is boosted and the vacuum degree is improved.

The front side of the machine body 1 is provided with a chamber door 9 for opening the rolled bag chamber; and the rolled bag 11 is replaced by opening the chamber door 9, so that the rolled bag 11 is more convenient to be handled.

In the embodiment, the rolled bag 11 is replaced through the chamber door 9; the packaging bag for packing products is drawn from the rolled bag 11; after the product is packed, the packaging bag is delivered to the tray 3 and then is vacuumized and sealed.

The embodiment is the better implementation mode of the utility model and is not the limit to the utility model. Without getting out of the inventive concept of the utility model, any obvious replacement is within the protective scope of the utility model.

What is claimed is:

1. A cavity-type vacuum sealing machine, comprising a machine body (1) and a cover (2) which covers the machine body, characterized in that the machine body is internally provided with a tray (3); an airtight cavity for holding packaging bags is formed between the tray and the cover; the cavity is internally provided with a hot-pressing bar (5) and a heating and sealing component (6) for sealing the packaging bags; the machine body is internally provided with a vacuum pump set (4) for vacuumization; and suction ports of the vacuum pump set communicate with the airtight cavity for holding the packaging bags; the vacuum pump set (4) is a vacuum pump, comprising a housing, a driver (402) and air pumps (404) driven by the driver; the driver (402) is a dual-head motor; output shafts (4021) at two ends of the motor are connected with eccentric wheels (403); four air pumps (404) are arranged; one eccentric wheel is connected with two air pumps; each air pump is connected with a suction port (406) of the suction ports and an exhaust port (407), which communicate with the air pump; and one-way valves (405) are arranged between the suction ports and the air pumps and between the exhaust ports and the air pumps.

2. The cavity-type vacuum sealing machine according to claim 1, wherein the machine body is internally provided with a rolled bag chamber for holding rolled bags; the rolled bag chamber is located in a front part of the machine body (1); and a front side of the machine body is provided with a chamber door (9) for opening the rolled bag chamber.

3. The cavity-type vacuum sealing machine according to claim 2, wherein a bottom side of the tray (3) is an oblique plane and mouths of the packaging bags in the cavity are located on top side of the oblique plane.

4. The cavity-type vacuum sealing machine according to claim 3, wherein a connecting rod (7) is arranged between the cover (2) and the machine body (1) and two ends of the connecting rod are respectively hinged with the cover and the machine body.

5. The cavity-type vacuum sealing machine according to claim 4, wherein the cover (2) comprises an upper cover (21) and a lower cover (22) which fit together, and a control panel (10) is arranged on the upper cover.

6. The cavity-type vacuum sealing machine according to claim 5, wherein the machine body (1) is provided with a safety switch (8) and is actuated through the connecting rod.

7. The cavity-type vacuum sealing machine according to claim 1, wherein each air pump (404) comprises a connecting rod (4041), a piston (4042) connected with the connecting rod and a cylinder (4043) having an air cavity; a head of the connecting rod is connected to an eccentric position of the eccentric wheel; and the cylinder is provided with a cylinder bottom cover, which is provided with a suction passage and an exhaust passage.

8. The cavity-type vacuum sealing machine according to claim 7, wherein each one-way valve (405) comprises a valve (4051) and a valve bottom cover (4052); the valve is located between the cylinder bottom cover and the valve bottom cover; the valve is provided with two air-blocking pads (511) which are respectively located at the suction passage and the exhaust passage; and the valve bottom cover is provided with air passages, which respectively communicate with the suction ports (406) and the exhaust ports (407).

9. The cavity-type vacuum sealing machine according to claim 8, wherein the housing comprises an upper cover (4011) and a lower cover (4012), which are buckled with each other.

* * * * *